US008177452B2

(12) United States Patent
Tsai

(10) Patent No.: US 8,177,452 B2
(45) Date of Patent: May 15, 2012

(54) NAIL POLISH CONTAINER

(76) Inventor: Yi Li Tsai, Taichung (TW)

( * ) Notice: Subject to any disclaimer, the term of this patent is extended or adjusted under 35 U.S.C. 154(b) by 486 days.

(21) Appl. No.: 12/420,063

(22) Filed: Apr. 8, 2009

(65) Prior Publication Data

US 2010/0260532 A1 Oct. 14, 2010

(51) Int. Cl.
*A46B 11/04* (2006.01)

(52) U.S. Cl. ..... 401/272; 401/270; 401/204; 401/279

(58) Field of Classification Search ..... 401/188 R, 401/187, 143, 101, 109, 135, 198, 199, 107, 401/112, 117, 169, 204–206, 270, 272, 273, 401/279

See application file for complete search history.

(56) References Cited

U.S. PATENT DOCUMENTS

| | | | | |
|---|---|---|---|---|
| 4,747,419 | A * | 5/1988 | Flynn et al. | 132/73 |
| 4,940,351 | A * | 7/1990 | Konose | 401/278 |
| 4,993,437 | A * | 2/1991 | Kimura et al. | 132/112 |
| 5,035,525 | A * | 7/1991 | Konose | 401/278 |
| 5,137,388 | A * | 8/1992 | Kimura | 401/278 |
| 5,339,841 | A * | 8/1994 | Gueret | 132/218 |
| 6,209,548 | B1 * | 4/2001 | Harrison et al. | 132/74.5 |
| 6,231,256 | B1 * | 5/2001 | Kingsford et al. | 401/108 |
| 6,234,181 | B1 * | 5/2001 | Lou | 132/313 |
| 6,530,709 | B1 * | 3/2003 | Washington | 401/272 |
| 6,905,277 | B2 * | 6/2005 | Saito et al. | 401/281 |
| 6,935,802 | B1 * | 8/2005 | Byun | 401/278 |
| 6,986,620 | B2 * | 1/2006 | Abbas | 401/188 A |
| 7,059,796 | B2 * | 6/2006 | Lewis et al. | 401/107 |
| 7,086,799 | B1 * | 8/2006 | Pappageorge et al. | 401/206 |
| 7,101,107 | B1 * | 9/2006 | Byun | 401/286 |
| 7,314,329 | B1 * | 1/2008 | Byun | 401/279 |
| 7,329,062 | B2 * | 2/2008 | Brand et al. | 401/108 |
| 2009/0285622 | A1 * | 11/2009 | Veasey et al. | 401/266 |

FOREIGN PATENT DOCUMENTS

| | | | |
|---|---|---|---|
| GB | 2173743 A | * | 10/1986 |
| GB | 2227650 A | * | 8/1990 |

* cited by examiner

*Primary Examiner* — David J. Walczak
*Assistant Examiner* — Jennifer C Chiang
(74) *Attorney, Agent, or Firm* — Leong C. Lei

(57) ABSTRACT

A nail polish container includes an outer barrel having a dispense nozzle and a detachable refill container. The dispense nozzle includes a brush and a dispense tube seat mounted therein. The refill container contains therein a liquid content and has a top mouth receiving therein a volume-regulating valve seat and a tubular sleeve. When the refill container is fit into the outer barrel, a dispense tube of the dispense tube seat is inserted into the valve seat, whereby depression of the refill container may cause the valve to open to allow the nail polish contained in the refill container to flow, in a volume-regulated manner, to the brush for performing application of the nail polish.

2 Claims, 5 Drawing Sheets

NAIL POLISH CONTAINER

TECHNICAL FIELD OF THE INVENTION

The present invention generally relates to a nail polish container comprising a refill container and a brush-carrying outer barrel that are made separately and then assembled together, so that the refill container is easily detached for refill of liquid content, and a dispense tube extending from the brush to directly insert into a volume-regulating valve seat that is mounted to an opening of the refill container whereby in use, depression of the refill container causes the dispense tube to push open the discharge opening of the valve, realizing easy dispense control of volume-regulated release of the liquid content to ensure convenience and practicability of application of nail polish and further provide the function of easy assembling of construction and convenient refilling of nail polish.

DESCRIPTION OF THE PRIOR ART

Conventionally, application and refill of nail polish is effected by filling a cosmetic liquid into a jar-like container and a top opening of the container is closed by a cap, usually by means of threading engagement. The cap is provided with an application stick having a predetermined length and brittles are attached to a free end of the application stick and are directly deposited into the interior space of the nail polish container and dipped in the nail polish contained in the container. To use, the cap is rotated to open and the brittles with nail polish attached to thereto is removed out of the container for application to nails. However, the brittles often carry an excessive amount of nail polish and the excessive nail polish must be scraped off along an opening rim of the container before the nail polish is applied to the nails. Further, the application stick is often stained with the nail polish when put into and removed out of the container and such nail polish stain may fall off the stick due to the movement thereof during the application of the nail polish. This causes certain problems and troubles to the users. To overcome such a problem, a fixed-amount dispensing nail polish applicator is available and FIGS. 5 and 6 shows an example of such a fixed-amount dispensing nail polish applicator, which generally comprises a container body 40 that receives and holds a cosmetic liquid therein and having a top to which a dispensing device is coupled. The dispensing device comprises a cone-shaped dispense nozzle 41 through which a brush 42 is inserted. The nozzle receives therein a dispense base 43. The container body 40 receives, in a lower portion thereof, a valve disk 44 and a rod 45 that cooperate with a positioning seat 46 to secure the rod in position. The rod has flattened side faces for retaining a resilient piece 47 and being set in driving coupling with a unidirectional rotation control assembly 48 that is operated by means of mutual-engagement of ratcheted/toothed surfaces. By means of depressing an externally mounted depression control member 49, the ratchet based rotation control assembly 48 is caused to perform unidirectional rotation and successive operation of unidirectional rotation of the rod 45 is realized, which in turn causes the valve disk 44 to slide deeply into the interior of the container body 40 for forcibly dispensing the contents thereof. Such a structure is operated by the depression of the depression control member 49 and the rod 45 is caused by the ratchet based unidirectional rotation control assembly 48 to perform a stepwise dispensing operation under the guidance of the positioning seat 46. As such, fixed-amount dispense of the nail polish is realized. Such a design, after commercialized, is popular in the market. However, the construction is very complicated, making the manufacturing and assembling difficult. Further, the cosmetic liquid filled therein will have a certain amount of residual liquid remaining therein and cannot be fully used up. In addition, refill for reuse of the container is impossible. This also causes an increase of the costs of manufacturing and use. Handling after disposal is also a trouble for environmental conservation. Thus, it is desired to further improve the nail polish container.

SUMMARY OF THE INVENTION

In view of the above drawbacks found in the manufacturing and structure of the conventional nail polish container, the present invention aims to provide a nail polish container which comprises a refill container that is detachable from an outer barrel and forms a discharge opening to which a volume-regulating valve is mounted, whereby with the refill container fit to the outer barrel, depression of the refill container causes the volume-regulating valve to open the discharge opening in a stepwise manner for effective control of volume-regulated dispense of the nail polish and whereby easy refill of the nail polish may be carried out in an independent manner. Consequently, nail polish application is made with a device of simple, replaceable, and reusable structure and the above discussed drawbacks are overcome.

A primary objective of the present invention is to provide a nail polish container, which comprises an outer barrel and a detachable refill container that are manufactured separately and then fit together, whereby the refill container can be easily refilled in an independent manner. The outer barrel has a cone-shaped dispense nozzle comprising a dispense tube seat fit into a volume-regulating valve seat mounted to an open top of the refill container, whereby in use, a stepwise operation for effecting flexible volume-regulated dispense of nail polish can be carried out by simply depressing the refill container, by which steady dispense of nail polish can be realized and structure and assembling are simplified, leading to substantial reduction of manufacturing costs. Further, reuse and change of color can be realized through refilling of replenishment liquid to the refill container. Thus, application of nail polish is made effective, practical, and environmentally conservative.

The foregoing objective and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

The present invention will now be explained with reference to the drawings for better understanding of the structure and features of the present invention.

Figure 1:
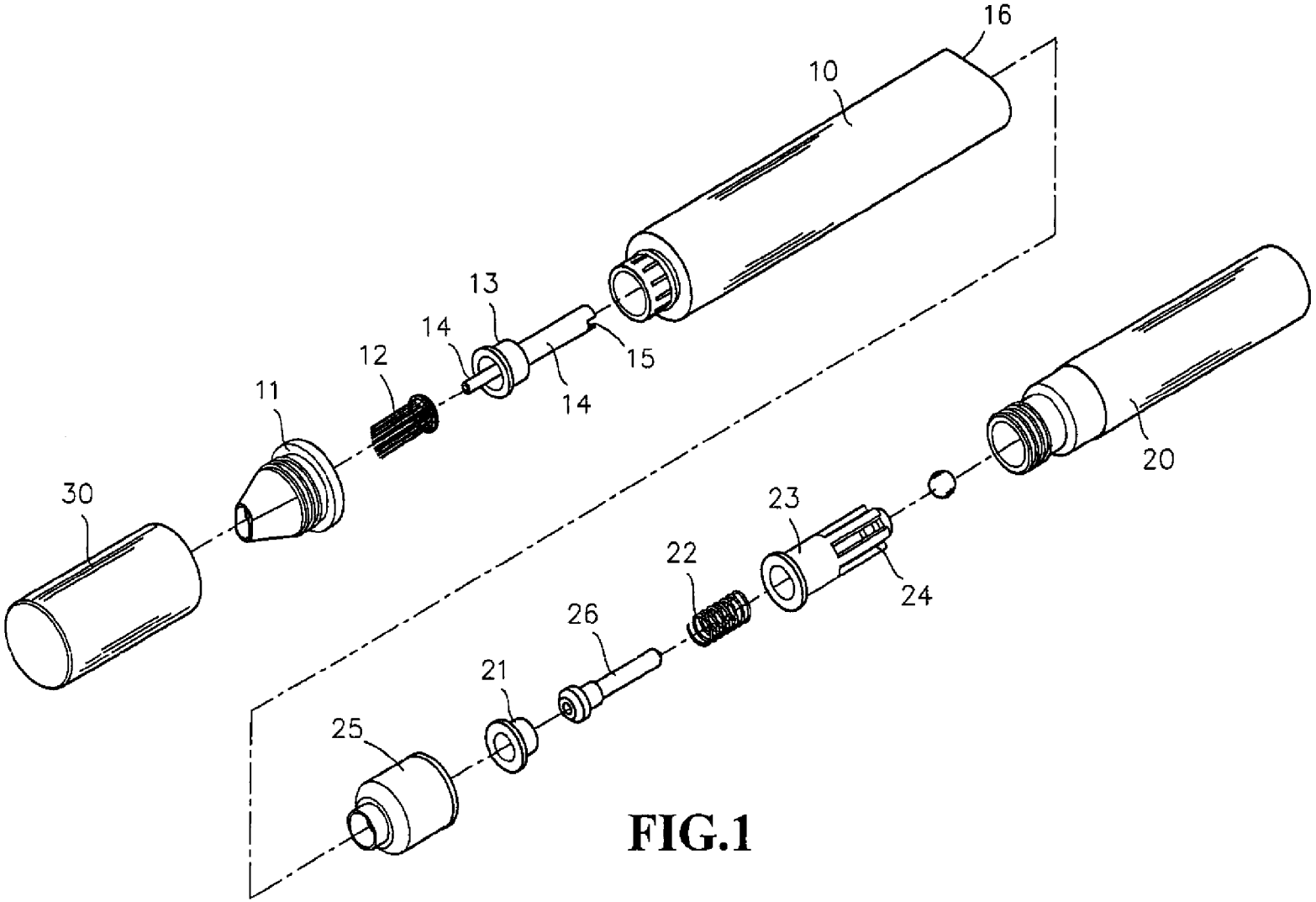
FIG. 1 is an exploded view of a nail polish container in accordance with the present invention.
Figure 2:
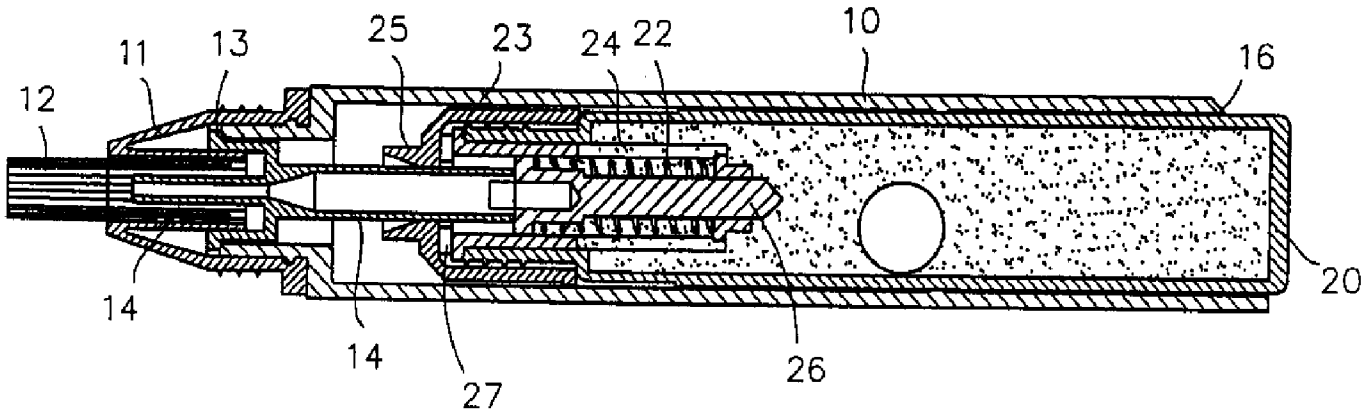
FIG. 2 is a cross-sectional view of the nail polish container of the present invention.
Figure 3:
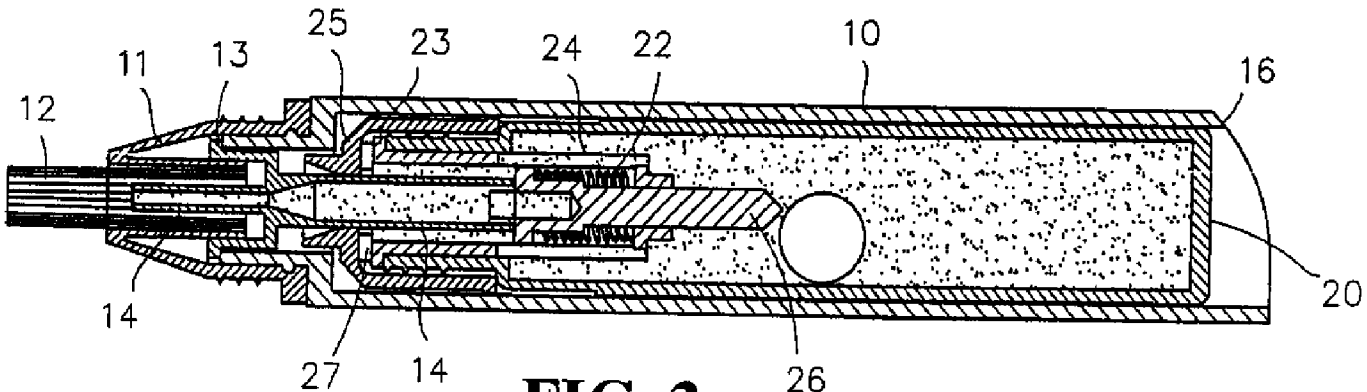
FIG. 3 is also a cross-sectional view of the nail polish container of the present invention, but shown in a depressed, operation condition.
Figure 4:
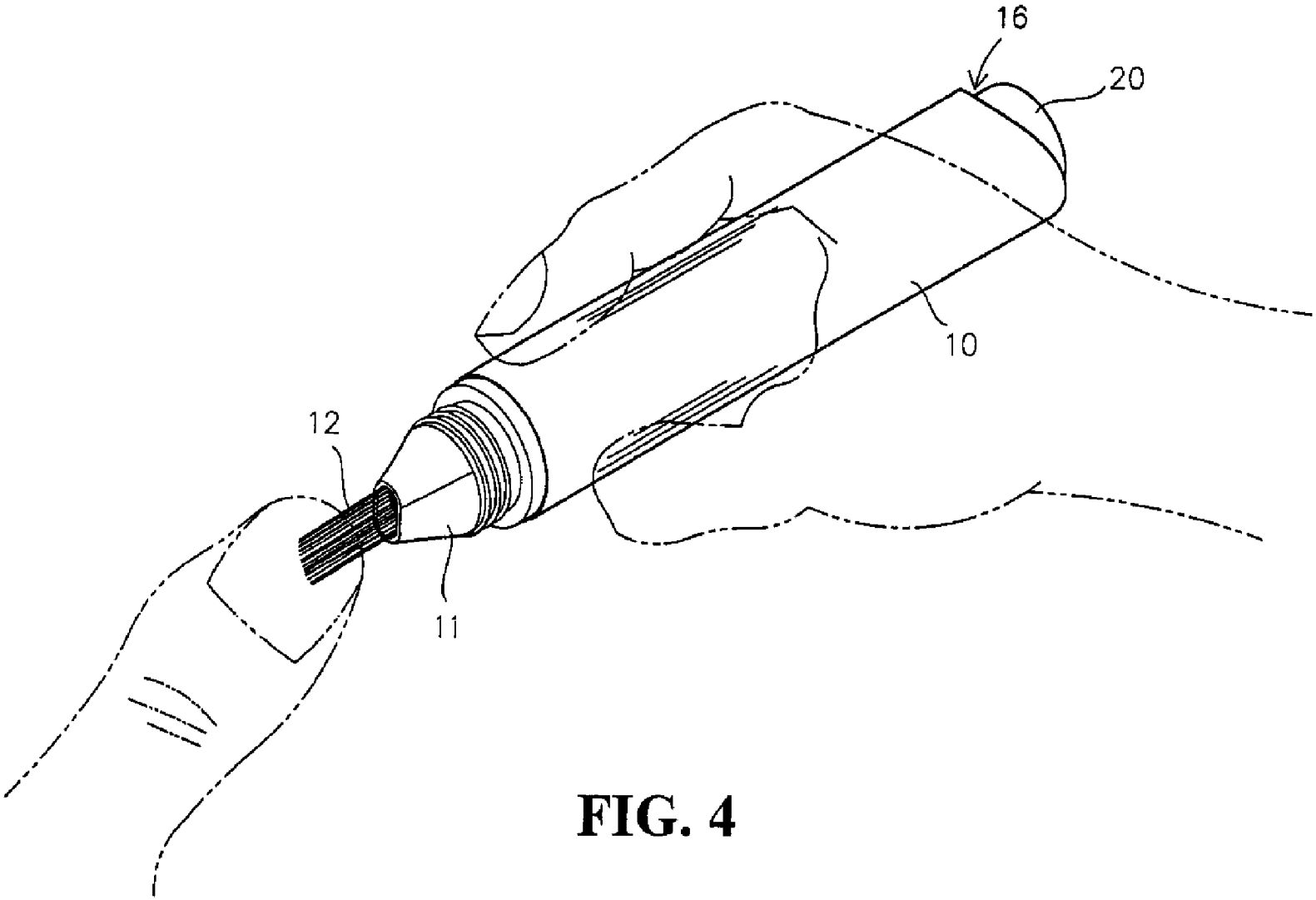
FIG. 4 is a schematic view illustrating the use of the nail polish container of the present invention.
Figure 5:
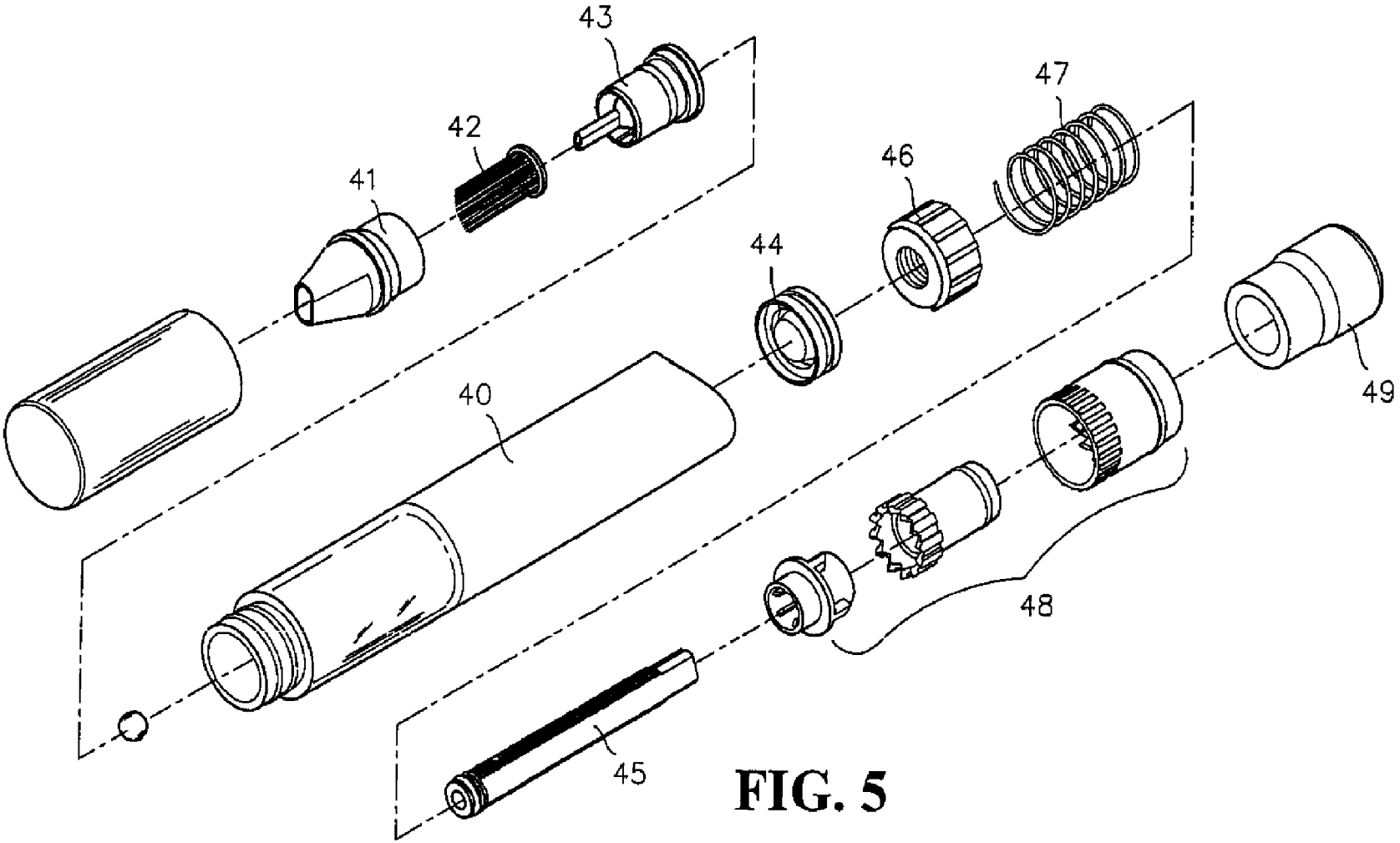
FIG. 5 PRIOR ART
FIG. 5 is an exploded view of a conventional nail polish container.
Figure 6:
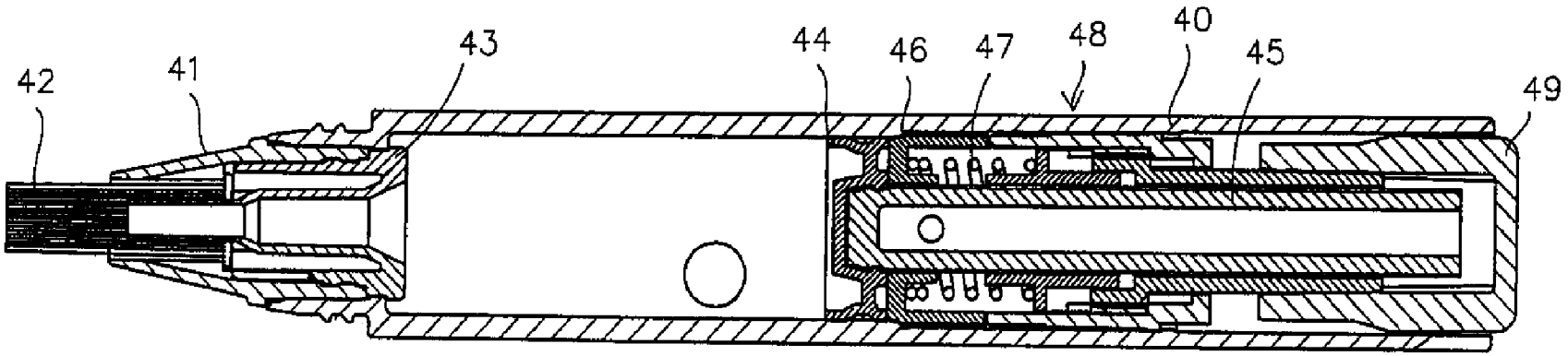
FIG. 6 PRIOR ART
FIG. 6 is a cross-sectional view, in an assembled condition, of the conventional nail polish container.

The present invention provides a nail polish container, of which the construction is illustrated in FIGS. 1-4, comprising a handheld outer barrel 10 having an end forming a reduced rim to couple with an assembly of a generally cone-shaped dispense nozzle 11 that comprises a conic head having an outlet opening or mouth into which a brush 12 is fit. To make the bristles of the brush distributed in a uniform manner, the outlet opening is formed as a conic rim having an elliptic opening. A base of the brush 12 is fixed to a top end of a dispense tube seat 13 received in a lower end of the nozzle 11 in such a way that a dispense tube 14 of the dispense tube seat 13 extends to a proper distance into the brush 12, while a lower section of the dispense tube 14 extends a proper length to form a lower end forming an opening delimited by a circumferential wall that defines an inwardly recessed notch 15 to serve as an inlet passage for liquid inflow. The complete set of the dispense nozzle 11 so assembled together is preferably fixedly coupled to the outer barrel 10. A refill container 20, which is made tubular, contains therein a cosmetic liquid and has a top end forming a refilling opening and also serving as a discharge outlet. The refill container 20 is provided with a volume-regulating valve seat 21 that constitutes a valve having a bottom to which a resilient piece 22 is mounted and received in a U-shaped tubular sleeve 23. The tubular sleeve 23 has an open end and a lower portion defined by a circumferential surface in which elongate openings 24 are defined and lined up circumferentially, whereby when tubular sleeve 23 is fit into the refill container 20, the liquid contained in the refill container 20 is allowed to easily flow into the interior of the tubular sleeve 23 through the openings 24 and control of dispense of the liquid can then be realized through opening/closing operations of the volume-regulating valve seat 21. The tubular sleeve 23, after fit to the volume-regulating valve seat 21, is coupled by a mounting cap 25 that has a resiliently deformable central bore and that has an interior space receiving therein a sealing member 27 to have the whole set of tubular sleeve 23 so assembled fixed to the opening end of the refill container 20. With the internally arranged resilient piece 22 biasing a plunger bar 26 of the valve seat 21 toward and thus closing a discharge opening, the refill liquid is prevented from leaking to the outside. To assemble, the refill container 20 is inserted into the interior of the outer barrel 10 to have the dispense tube 14 that extends downward in the dispense nozzle 11 to penetrate to a proper location above the top of the plunger bar 26 that is inside the volume-regulating valve seat 21 of the tubular sleeve 23. The dispense tube 14 has a diameter that is fit into and corresponds to a diameter of the resiliently deformable bore of the mounting cap 2 so that the fitting therebetween realizes hermetic engagement and positioning to provide a leak-proof effect. The lower end of the dispense tube 14 is set in a tightly abutting engagement with the top of the plunger bar 26. As such, a complete depression-actuating nail polish dispense control assembly is constructed. An outer cap 30 is set outside the dispense nozzle 11 of the outer barrel 10 to cover the cone-shaped dispense nozzle 11 and thus forming a completely enclosed nail polish container structure.

To apply the nail polish, a lower end of the refill container 20 that slightly projects beyond a lower end of the outer barrel 10 is conveniently depressed through a recessed curved cutoff 16 that is formed in one side wall of the lower end of the outer barrel 10 to allow a finger to effect depression in a direction toward the dispensing end, whereby the refill container 20, after being depressed, is retracted into the outer barrel 10 to a proper location, and during the course of retraction, the dispense tube 14 of the dispense tube seat 13, which is set inside an inner end of the outer barrel 10, drives the plunger bar 26 of the volume-regulating valve seat 21 downward, simultaneously downward compression of the resilient piece 22 that provides biasing support inside the inner end to open the discharge opening. With the communication realized through the openings 24 defined in the lower portion of the tubular sleeve 23, communication with the interior of the refill container 20 can be established, which allows the cosmetic liquid contained in the refill container to flow along the communicative passage and pass through the notch 15 of the dispense tube 14 to the bottom of the brush 12 located outside the dispense nozzle 11, whereby the nail polish can be uniformly coated on the brush 12. When the depression of the refill container 20 is released, the internally arranged resilient piece 22 biases the plunger bar 26 back to a sealing position that closes the discharge opening whereby volume-regulated and depression-controlled dispense can be realized. Consequently, easy operation for nail makeup can be realized by a user by simply holding the outer barrel 10 and easy control the amount of the cosmetic liquid dispensed can be easily controlled by simply depressing the refill container 20. Thus, convenient and safe use of nail polished is realized. After the use, a simple operation of capping by the outer cap 30 can provide the effects of sealing and convenient carrying.

In use of the nail polish container in accordance with the present invention, a user simply removes the outer cap 30, followed by depressing the refill container 20 to have the refill container 20 retracted into the outer barrel 10 to a proper location, and with the dispense tube 14 depressing the plunger bar 26 of the volume-regulating valve set that is assembled in the tubular sleeve 23, control of stepwise dispense can be realized so that the cosmetic liquid contained in the refill container 20 can be uniformly spread over the brush 12 for uniform application to nails. With the stepwise depression-controlled dispense, when the amount of the liquid on the brush 12 is lessened, depression once again may allow a proper amount of the liquid to be dispensed for supplement and thus application with proper amount can be realized. Further, the construction of the nail polish container allows the refill container 20 to be separated independently. This not only makes the filling in a manufacturing process convenient, but also allows for easy detachment for refilling and reuse after the liquid contents are consumed up. In other words, a single nail polish application brush can be used to apply cosmetic materials of different color through simple replacement of the refill container 20. This meets the current changeable fashion and also helps conservation of environment through the repeated refilling nature. The construction is simple, which not only makes the manufacturing easy and provide characteristics of convenient use, but also reduces the manufacturing costs, and thus effectively enhancing the value in respect of the manufacturing of the nail polish container and convenient operation thereof.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A nail polish container comprising:

an outer barrel having a first open end and a second open end, said first open end having a reduced rim;

a cone-shaped dispense nozzle coupled to said reduced rim of said outer barrel, said cone-shaped dispense nozzle having a conic outlet opening that is made elliptic in shape;

a brush fitted in said cone-shaped dispense nozzle and having bristles uniformly distributed by said conic outlet opening of said cone-shaped dispense nozzle;

a dispense tube seat received in an open end of said cone-shaped dispense nozzle and bearing against an inner wall of said open end of said cone-shaped dispense nozzle, said dispense tube seat having a dispense tube, said dispense tube having a first end extending into said brush and a second end extending into said first open end of said outer barrel, said second end of said dispense tube having an opening delimited by a circumferential wall that defines an inwardly recessed notch to serve as an inlet passage for liquid inflow;

a refill container containing a cosmetic liquid and inserted into said second open end of said outer barrel;

a mounting cap engaged with an open end of said refill container and having a resilient deformable central bore;

a sealing member fitted in said mounting cap;

a tubular sleeve having a U-shaped cross-section and having a plurality of elongate openings defined and lined up circumferentially on a circumferential surface of said tubular sleeve, said tubular sleeve being fitted into said refill container, a volume-regulating valve seat fitted in said tubular sleeve;

a plunger bar fitted in said tubular sleeve and having an end extending through said volume-regulating valve seat out of said tubular sleeve, said plunger bar having an end in abutting engagement with said second end of said dispense tube;

a resilient piece fitted in said tubular sleeve and tending to force said plunger bar toward said mounting cap thereby closing said elongate openings of said tubular sleeve and therefore preventing said cosmetic liquid in said refill container from flowing through said dispense tube into said brush; and said dispense tube having a diameter that is fit into and corresponds to a diameter of said resilient deformable bore of said mounting cap in hermetic engagement and positioning manner so as to prevent leakage;

an outer cap engageable with said cone-shaped dispense nozzle;

wherein when in use, by depressing and retracting said refill container into said outer barrel, said tubular sleeve will be moved with respect to said plunger bar towards said dispense tube seat thereby opening said elongate openings of said tubular sleeve and therefore enabling said cosmetic liquid in said refill container to flow through said dispense tube into said brush, and when said refill container is released, said resilient piece returns said tubular sleeve back to close said elongate openings of said tubular sleeve thus preventing cosmetic liquid in said refill container from flowing through said dispense tube into said brush.

2. The nail polish container as claimed in claim 1, wherein said second open end of said outer barrel has a recessed curved cutoff to allow a finger to effect depression.

* * * * *